US005550355A

United States Patent [19]

Jung

[11] Patent Number: 5,550,355

[45] Date of Patent: Aug. 27, 1996

[54] MICROWAVE OVEN DRIVING CONTROL METHOD AND APPARATUS THEREOF

[75] Inventor: Kyung-Han Jung, Seoul, Rep. of Korea

[73] Assignee: Samsung Electronics Co., Ltd., Suwon, Rep. of Korea

[21] Appl. No.: 267,399

[22] Filed: Jun. 29, 1994

[30] Foreign Application Priority Data

Jun. 29, 1993 [KR] Rep. of Korea ..... 93 11952

[51] Int. Cl.[6] ..... H05B 6/68

[52] U.S. Cl. ..... 219/709; 219/710; 219/720; 374/122; 374/149; 99/325

[58] Field of Search ..... 219/709, 710, 219/711, 730, 759, 705, 720; 99/325, 451; 374/121, 122, 149

[56] References Cited

U.S. PATENT DOCUMENTS

| | | | |
|---|---|---|---|
| 3,412,227 | 11/1968 | Anderson | 219/709 |
| 3,527,915 | 9/1970 | Haagensen et al. | 219/709 |
| 3,662,140 | 5/1972 | Jones et al. | 219/709 |
| 3,670,134 | 6/1972 | Bucksbaum | 219/709 |
| 4,009,359 | 2/1977 | Tallmadge et al. | 219/705 |
| 4,870,234 | 9/1989 | Steers et al. | 219/710 |
| 4,871,891 | 10/1989 | Steers et al. | 219/710 |
| 4,962,000 | 10/1990 | Emslander at al. | 219/730 |
| 4,998,001 | 3/1991 | Cigarini et al. | 219/710 |
| 5,036,172 | 7/1991 | Kokkeler et al. | 219/710 |
| 5,378,875 | 1/1995 | Hirama et al. | 219/709 |

FOREIGN PATENT DOCUMENTS

| | | |
|---|---|---|
| 64-14889 | 1/1989 | Japan . |
| 2-35437 | 8/1990 | Japan . |

*Primary Examiner*—Philip H. Leung

*Attorney, Agent, or Firm*—Burns, Doane, Swecker & Mathis, L.L.P.

[57] ABSTRACT

During operation of a microwave oven, steps are taken to determine whether the oven is being operated in the absence of food therein and to shut down the oven if that state is found to exist. Initially, a high frequency detector disposed in the cooking chamber absorbs high frequency and produces heat in proportion to the absorbed high frequency. A temperature sensor senses the temperature of that produced heat and generates an output signal as a function thereof. After a predetermined time period, that output signal is compared to a reference value which represents a temperature expected to occur in the event that the oven is being operated in the absence of food. If it is determined from that comparison that no food is present in the oven, the oven is deactivated and an alarm is activated.

19 Claims, 5 Drawing Sheets

FIG. 9
(PRIOR ART)
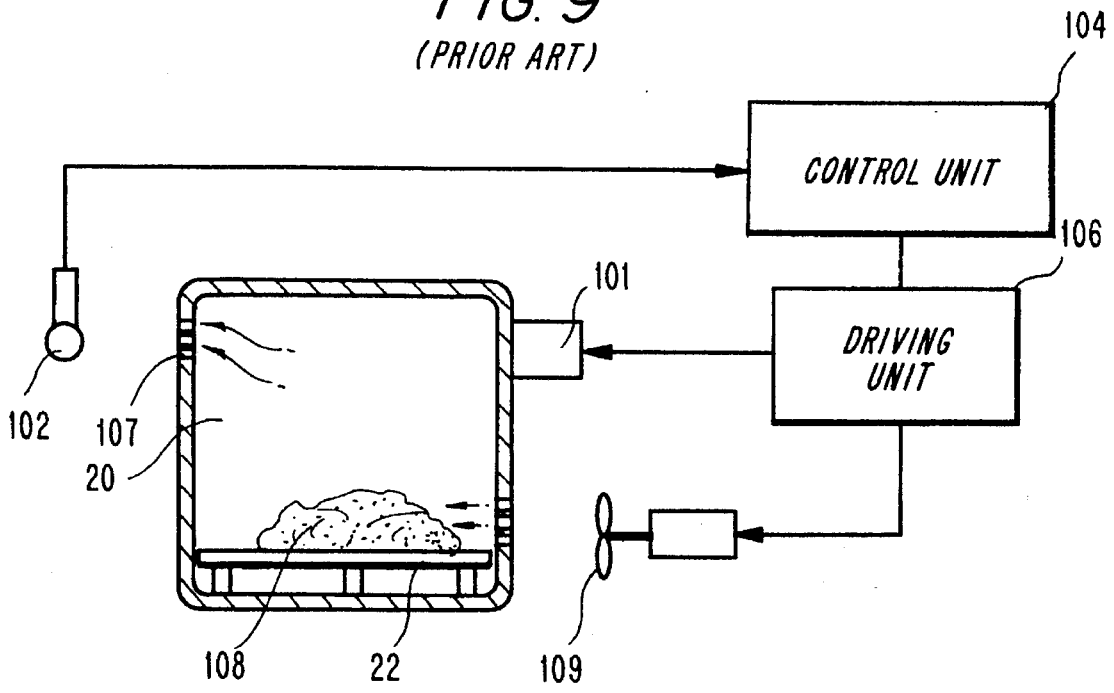
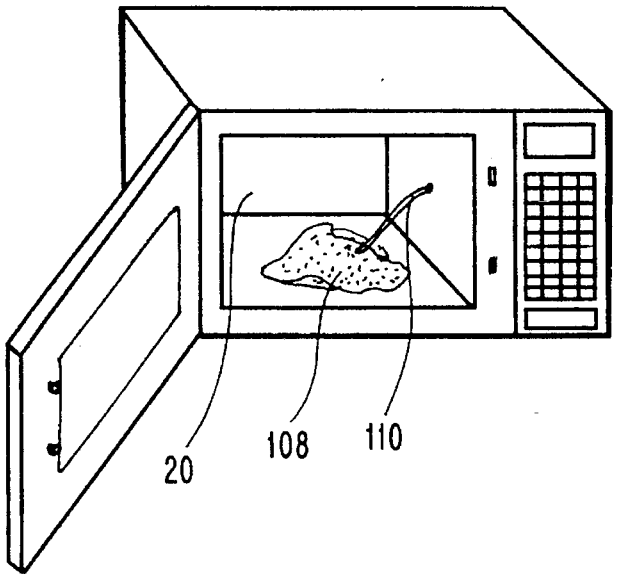
FIG. 10
(PRIOR ART)

MICROWAVE OVEN DRIVING CONTROL METHOD AND APPARATUS THEREOF

BACKGROUND OF THE INVENTION

1. Field of the Invention

The present invention relates to a driving control method of a microwave oven and an apparatus thereof utilizing high frequency, and more particularly to a micorwave oven driving control method and apparatus for detecting whether the microwave oven is being operated without any food disposed in the cooking chamber.

2. Description of the Prior Art

FIG. 9 illustrates how a conventional microwave oven is operated by its driving control apparatus.

According to FIG. 9, the driving control apparatus of the microwave oven having a cooking chamber 20 comprises: a magnetron 101; a temperature sensor 102 for detecting the temperature of exhaust gas coming out of an exhausting port 107; a control unit 104 for receiving a temperature signal from the temperature sensor 102 to compare the same with a predetermined reference temperature; and a driving unit 106 for receiving a driving signal from the control unit 104 to drive the magnetron 101.

Meanwhile, there is a fan 109 for cooling the magnetron 101 and at the same time for ventilating the air of the cooking chamber 20, and reference numeral 108 reference food to be cooked, and reference numeral 22 reference a tray on which to place the food 108.

However, in the conventional microwave oven thus constructed, it is impossible to detect (or discern) whether or not there is food within the cooking chamber, thereby causing damage to the oven or causing fire to break out in the oven when the oven is operated without the presence of food, due to a user's mistake or a child's mischievous act.

In other words, when the oven is operated with no food 108 in the cooking chamber 20, the temperature sensor 102 cannot detect such an absence immediately, which causes the tray 22 in the chamber 20 to melt down or causes an interior paint and the like to catch fire, resulting in consequent damage and loss to the oven.

FIG. 10 is another embodiment of the conventional microwave oven, wherein a probe 110 is disposed in the cooking chamber 20 to thereby detect temperature of the food 108 or temperature in the cooking chamber 20.

However, a no-load (no-food) state cannot be detected even with the probe 110, whereby there is still the danger of fire and the subsequent loss therefrom.

In other words, it is not until some time (i.e., after damage occurs) that the probe 110 detects operation of the oven under no load.

Accordingly, a prior art apparatus has been disclosed to detect a no-load state in such a cooker as microwave oven utilizing high frequency.

As an apparatus for detecting the no-load state, a differential coil type weight detecting device composed of a steel core is disposed under the tray on which the food is placed along with a coil from which induction current is generated by movement of the core.

According to the device, when the food is placed on the tray, the core moves downward.

At this time, the induction current is generated to thereby enable detection of existence of the food on the tray.

This kind of device, however, has a disadvantage in that a light weight quantity of food cannot be detected accurately and the device is expensive.

SUMMARY OF THE INVENTION

Accordingly, the present invention has been provided to solve the aforesaid problem, and it is an object of the present invention to provide a high frequency detecting means for detecting the high frequency generated from a high frequency generating means, and to provide a microwave oven driving control method and an apparatus for detecting a loaded state of the microwave oven by way of the high frequency detecting apparatus and at the same time for preventing the microwave oven from operating with no load on the tray.

In order to attain the aforementioned object, according to the present invention, the high frequency detecting apparatus comprises: a high fredquency absorbent body for absorbing high frequency generated from a high frequency generating apparatus to thereby generate heat; and a temperature detecting means for detecting the heat generated from the high frequency absorbent body.

In accordance with one aspect of the present invention, there is provided a driving control method of a microwave oven disposed with a high frequency detecting means, the method comprising the steps of: driving the high frequency generating means to thereby start cooking when a cooking condition and a cooking start signal are input by operation of a user; comparing a value of a signal output from the high frequency detecting means with a predetermined reference value when a predetermined period of time elapses after the cooking start step; performing the cooking according to the user's selection when the value output from the high frequency detecting means is lower than the reference value as a result of the comparison; and stopping driving of the high frequency generating means when the value output from the high frequency detecting means is higher than the reference value as the result of the comparion.

The driving control apparatus of the microwave oven according to the present invention comprises a cooking chamber for receiving food and a high frequency generating means, a high frequency detecting means for outputting a predetermined signal corresponding to a high frequency incident to the cooking chamber; and a control means for receiving a predetermined signal output from the high frequency detecting means to thereby determine the loaded state and to control the high frequency generating means according to that determination.

BRIEF DESCRIPTION OF THE DRAWINGS

A fuller understanding of the nature and objects of the invention, reference should be made to the following detailed description taken in conjunction with the accompanying drawings in which.

Figure 7:
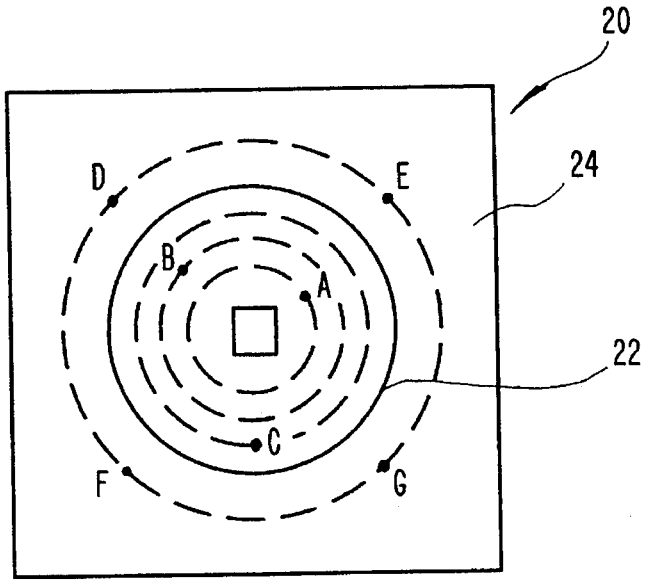
Figure 8:
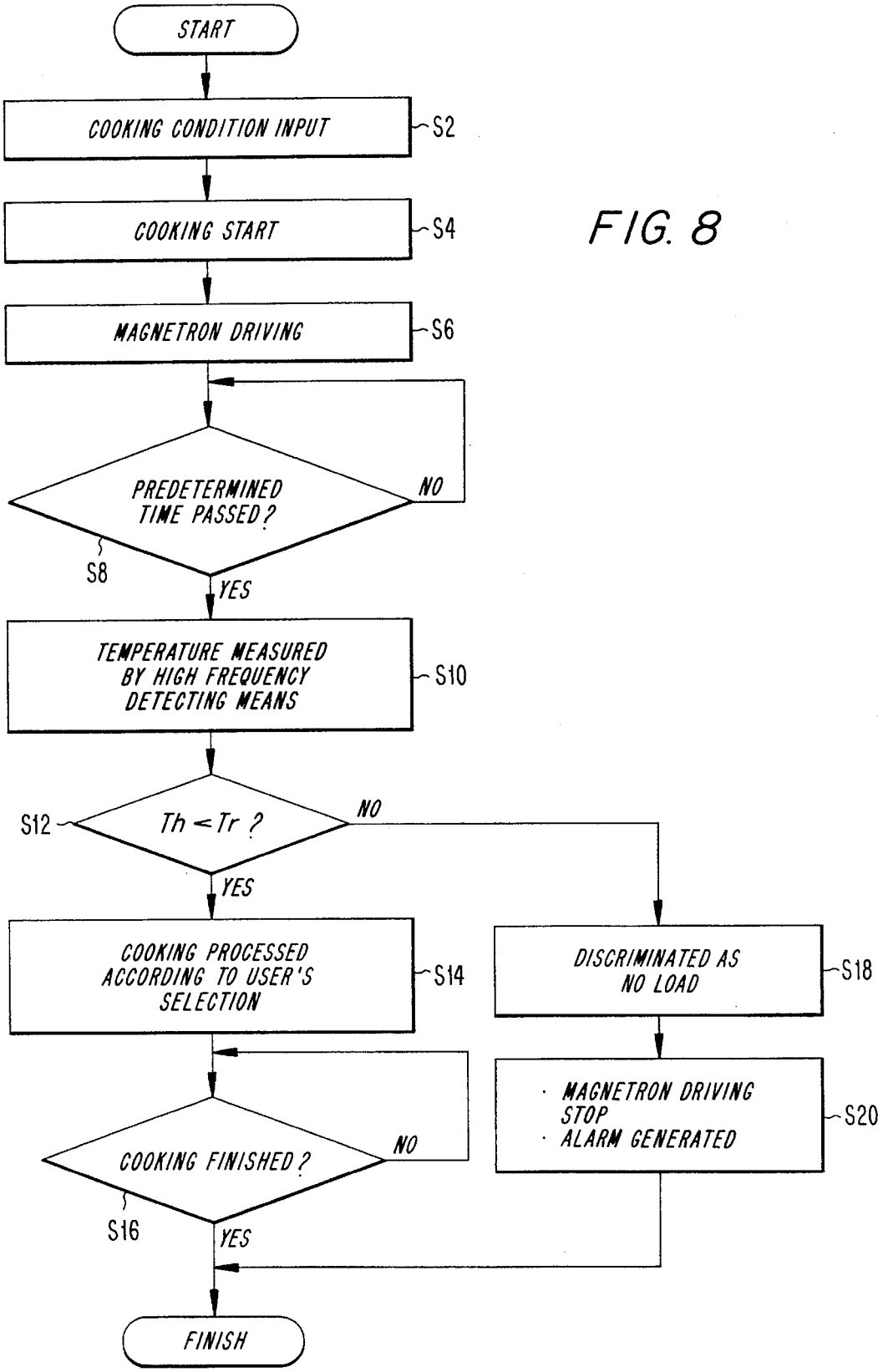

FIGS. *5a* and *5b* are respectively side and section views of a second embodiment of the high frequency detecting means according to the present invention;

FIGS. *6a* and *6b* are side and section views of a third embodiment of the high frequency detecting means according to the present invention;

FIG. 7 is a schematic plan view depicting the positioning of the high frequency detecting means according to the present invention;

FIG. 8 is a flow chart illustrating a driving control method of the microwave oven according to the present invention;

FIG. 9 is a block diagram of a driving control apparatus in a conventional microwave oven; and FIG. 10 is a block diagram of a driving control apparatus in a conventional microwave oven.

DETAILED DESCRIPTION OF THE PREFERRED EMBODIMENTS OF THE INVENTION

Figure 1:
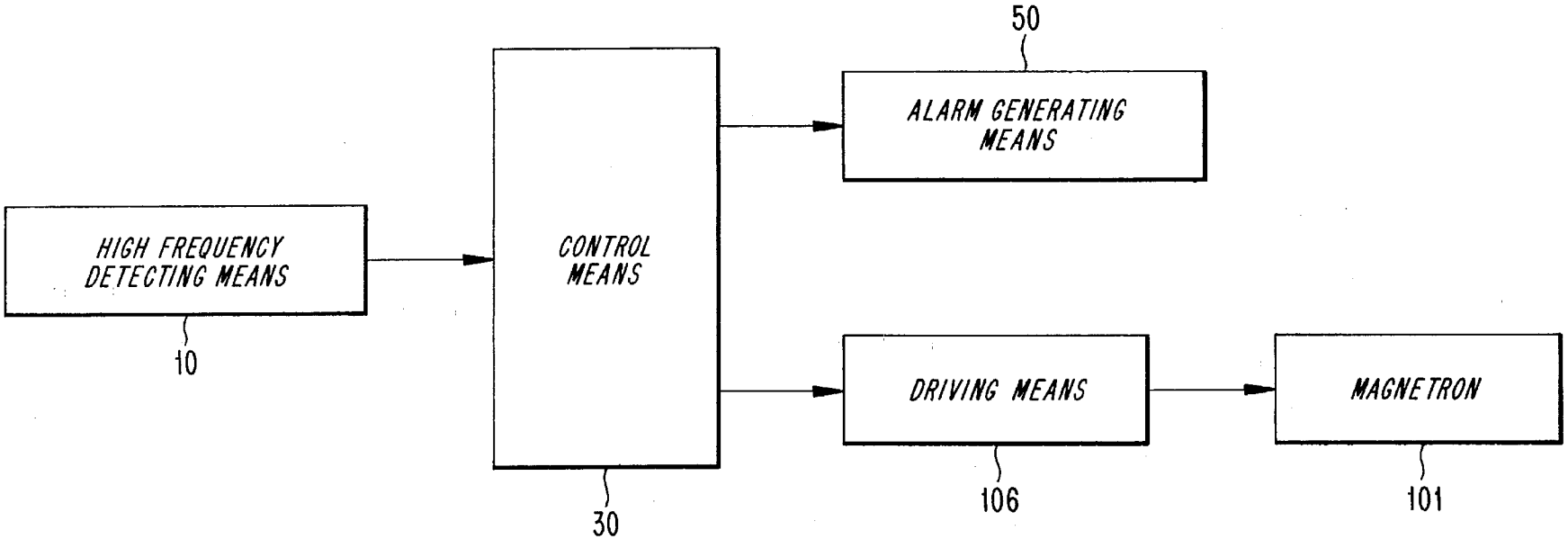
FIG. 1 is a block diagram of a driving control apparatus according to one embodiment of the present invention.

In FIG. 1, reference numeral 10 references a high frequency detecting means according to the invention (to be described in greater detail hereinafter). That detecting means outputs a signal in response to a high frequency generated from the magnetron 101 and incident to a cooking chamber of the microwave oven.

Reference numeral 30 reference a control means which receives the predetermined signal output from the high frequency detecting means 10 to thereby determine a temperature of the cooking chamber, and according to a result of the determination outputs a control signal in order to drive the magnetron 101 and an alarm generating means 50.

Reference numeral 106 is a driving means for driving the magnetron 101 according to the control signal output from the control means 30.

The alarm generating means 50 is operated according to a control signal output from the control means 30 when the microwave oven is operated with no food therein, i.e., operated under a no-load state, to thereby advise the user that the microwave oven is being operated with no load. The alarm generating means 50 comprises a liquid crystal display panel for displaying visually the no-load state to the user and a buzzer for generating a noise that can be heard by the user.

Figure 2:
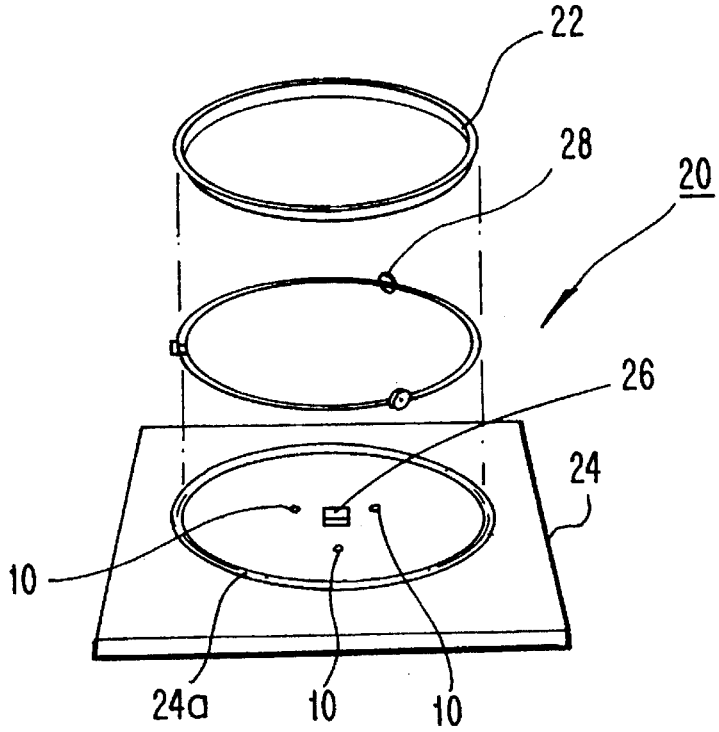
FIG. 2 is an exploded perspective view of parts of the microwave oven according to the present invention.

FIG. 2 is an exploded perspective view of part of the cooking chamber 20 for illustrating one embodiment of the location of the high frequency detecting means 10 in the driving control apparatus according to the present invention.

According to FIG. 2, a coupler 26 connected to an axle of a motor (not shown) is disposed at the center of a lower plate 24 comprising a floor of the cooking chamber 20.

A tray 22 is connected to the coupler 26 for receiving food to be cooked.

In other words, a groove (not shown) is formed under a lower surface of the tray 22 and into which the coupler 26 is insertedly connected.

At least three (3) rotating rollers 28 are disposed between the plate 24 and the tray 22.

Furthermore, a circular concave area 24*a* is formed on the plate 24.

Accordingly, when the tray rotating motor (not shown) is rotated to thereby rotate the coupler 26, the tray 22 connected to the coupler 26 is rotated along with the rotating rollers 28 placed thereon.

At this time, the plurality of rotating rollers 28 are guided by the groove 24*a* formed in the plate 24.

Meanwhile, the high frequency detecting means 10 is disposed on the plate 24.

In FIG. 2, a plurality of the high frequency detecting means 10 is shown, however it should be apparent that only one high frequency detecting means 10 could be provided and mounted on a side wall of the cooking chamber or on an underside (not shown) of plate 24.

Figure 3:
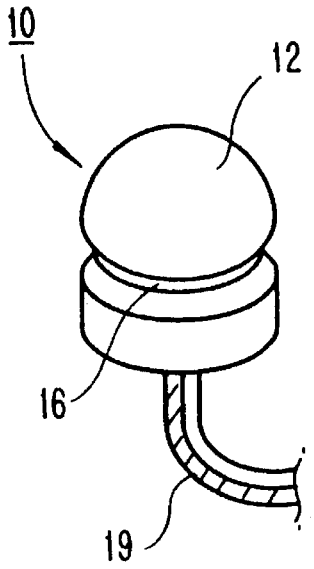
FIG. 3 is a perspective view of a first embodiment of a high frequency detecting means according to the present invention.
Figure 4:
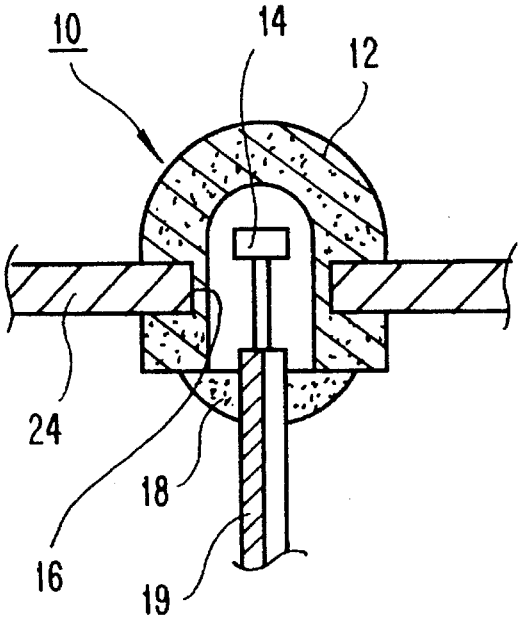
FIG. 4 is a sectional view of depicted in FIG. 3; the high frequency detecting means.

Meanwhile, FIG. 3 is a perspective view of one embodiment of the high frequency detecting means 10 illustrated in FIGS. 1 and 2, and FIG. 4 is a sectional view of the high frequency detecting means in its mounted disposed state as illustrated in FIGS. 1 and 2.

According to FIGS. 3 and 4, the high frequency detecting means 10 comprises: a high frequency absorbent body 12 for absorbing a high frequency (2,450 MHz) generated from the high frequency generating means to thereafter generate heat; and a temperature detecting element 14 for generating a predetermined temperature signal corresponding to the heat generated from the high frequency absorbent body 12.

At this time, the high frequency absorbent body 12 forms a groove 16 at its sides to thereby enable the same to be connected to the plate 24.

The high frequency absorbent body 12 is formed by compressing a powder composed of main ingredients and a binder. The main ingredients are MFeO, where M is Mn, Cu, Zn, Mg, or Co. The binder is a high molecular compound such as natural rubber, synthetic rubber, or plastic.

The powder particles comprising the high frequency absorbent body 12 have a diameter of 1–5 μm and the powder is a Ferrite Powder as is apparent from the foregoing.

Meanwhile, a thermocouple or thermistor and the like is used as the temperature detecting element 14, and is fixedly adhered to the high frequency absorbent body 12 by an adhesive 18 such as silicon resin and the like.

A cord 19 in the drawing is an incoming line of the temperature detecting element 14.

Figure 5A:
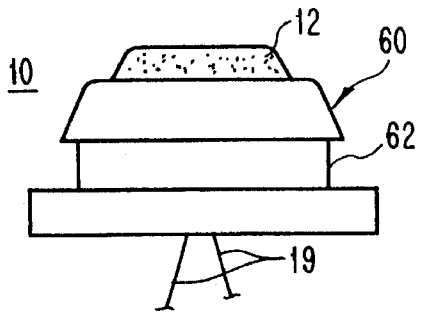
Figure 5B:
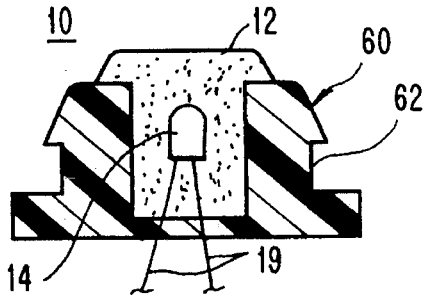

FIGS. 5*a* and 5*b* are respectively side and section views of another embodiment of the high frequency detecting means according to the present invention.

According to FIGS. 5*a* and 5*b*, the high frequency detecting means 10 comprises: the high frequency absorbent body 12 for absorbing the high frequency (2,450 MHz) generated from the high frequency generating means to thereafter generate heat; the temperature detecting element 14 for outputting a predetermined temperature signal corresponding to the heat generated from the high frequency absorbent body 12; and an insulation material 60 for preventing the high frequency absorbent body 12 from being affected by outside heat-related influence.

At this location, a groove 62 is formed on a side of the insulation material 80 to allow the same to be coupled to the plate forming the cooking chamber of the microwave oven.

It should be advisable that the insulation material 60 be the same as the coupling 26 illustrated in FIG. 2.

In other words, fluoro resin (for example Teflon) which has low heat transmissibility and low heat capacity is preferred for the insulation material.

Meanwhile, the high frequency absorbent body 12, the temperature detecting element 14 and the incoming line 19 have already been explained in connection with FIG. 4.

Figure 6A:
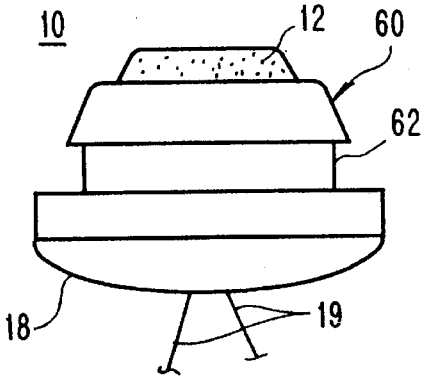
Figure 6B:
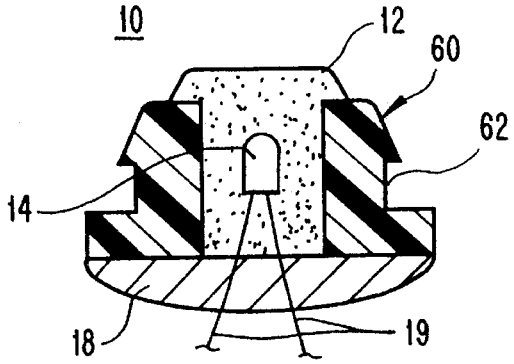

FIGS. 6*a* and 6*b* are respectively side and section views of still another embodiment of the high frequency detecting means according to the present invention.

According to FIGS. 6*a* and 6*b*, the temperature detecting element 14 is fixedly adhered to the high frequency absorbent body 12 by the adhesive such as silicon resin and the like.

Other elements which are of the same constructions as in FIGS. 5*a* and 5*b* have been given the same reference numerals and omitted in detailed explanation in order to avoid redendancy.

FIG. 7 is a plan view of another embodiment for illustrating a position of the high frequency detecting means according to the present invention.

According to FIG. 7, the high frequency detecting means 10 is disposed within a domain where the tray 22 is placed and is disposed at places (A, B and C) whose distances to a rotating center of the tray 22 are respectively different.

Furthermore, the high frequency detecting means 10 can be disposed at any places (D, E, F and G) where the tray 22 is not placed.

As seen from the foregoing, the high frequency detecting means 10 according to the present invention can be disposed at left, right, top or lower sides of the cooking chamber.

It should be advisable that the high frequency detecting means 10 be disposed at a lower surface of the cooking chamber because the high frequency is incident to the lower surface thereof and the food is placed there.

FIG. 8 is a flow chart of one embodiment for illustrating a driving control method of the microwave oven according to the present invention.

Accordingly, operational procedures of the microwave oven driving control apparatus according to the present invention will be described in detail with reference to the flow chart in FIG. 8.

First of all, after the user inserts an electrical cord of the microwave oven into an outlet in order to activate the microwave oven, he/she inputs cooking conditions such as cooking temperature, cooking period and the like as in step (S2) and presses a cooking start button to thereby allow the microwave oven to start cooking as in step (S4).

Then, the control means 30 of the microwave oven in step (S6), to the driving means 106 a control signal representing the cooking condition selected by the user to thereby drive the magnetron 101.

In other words, the control signal input by the user according to the cooking condition is output to the driving means 100 by the control means 30, and the driving means 106 drives the magnetron 101 according to the control signal output by the control means 30 to thereby generate the high frequency.

The high frequency generated by the magnetron 101 is incident to the cooking chamber through a waveguide (not shown).

The control means 30 then checks if a predetermined period of time (t1) has passed at step (S8).

At this time, the predetermined period of time (t1) can be calculated by experiments.

In other words, when the microwave oven is operated with no-load, the temperature in the cooking chamber 20 after the predetermined time period is higher than it would be if the cooking chamber 20 were operated with the food inserted, and the predetermined period of time (t1) can be defined as the time when the temperature difference can be expressly made.

As a result of the check at step (S8), if the predetermined period of time (t1) has passed, a comparison is made at steps (S10 and S12) between the temperature data within the cooking chamber output from the high frequency detecting means 10 and reference temperature data.

At this point, it should be advisable that the reference temperature data be established in accordance with the position where the high frequency detecting means 10 is disposed, because respective temperature distributions within the cooking chamber appear different.

Accordingly, it should be advisable that respetively different reference temperature data are established according to the position where the high frequency detecting means 10 is disposed.

As a result of the comparison at the step (S12) if the temperature data within the cooking chamber is lower than the reference temperature data, flow proceeds to perform steps (S14 and S16).

At the steps 14 and 16, the cooking is processed according the condition selected by the user.

If the comparison result at the step (S12) indicates that the temperature data within the cooking chamber is higher than the reference temperature data, it is determined at step (S18) determines that the cooking chamber has no load.

When it is discriminated at the step (S18) that the chamber has no load, control signal is output to the driving means 106 at step (S20), thereby stopping the driving of the magnetron 101 and at the same time, outputting an alarm signal by way of the alarm generating means 50, to alert the user that the chamber is empty.

In other words, when the alarm generating signal is output from the control means 30 to the alarm generating means 50, the user realizes that the microwave oven is operated with no load in the chamber and thereby takes necessary steps because word displays are shown on a liquid crystal display panel and the like telling whether there is any problem in the chamber and/or a buzzing sound is generated by a buzzer.

A plural number of high frequency detecting means can be provided.

At this time, the temperature data within the chamber detected by the plurality of high frequency detecting means 10 at the step (S12) in FIG. 8 are respectively compared with the reference temperature data, and if any temperature data in the cooking chamber is higher than the reference temperature data, it is determined that the chamber is empty.

At this time, the reference temperature data can be the same as the temperature data in the chamber, however, because regions of the chamber during no load operation of the microwave oven usually have respectively different temperature distributions, it should be advisable that the respective reference temperature data be different, i.e. established according to the position where the high frequency detecting means 10 is placed.

As seen from the foregoing, the microwave oven driving control method and apparatus thereof according to the present invention can detect the temperature in the cooking chamber by way of the high frequency detecting means to thereby obtain an effect of preventing damage and fire of the microwave oven resulting from carelessness on the part of the user.

Furthermore, the temperature in the cooking chamber can be detected to thereby obtain an effect of performing the cooking accurately.

The foregoing description and drawings are illustrative and are not to be taken as limiting.

Still other variations and modifications are possible without departing from the spirit and scope of the present invention.

Specifically, though the present invention has been explained in connection with a microwave oven with a turntable, it should be noted that a microwave oven operating under the electronic shower principal and the like can be provided with the present invention.

In other words, it should be noted that the invention can applied without regard to the method of dispersing the high frequency.

Furthermore, though the present invention has described with the high frequency absorbent body as having a mounting groove, the high frequency absorbent body can be attached in the cooking chamber by a bolt and nut, and the object of the present invention can be obtained by the high frequency absorbent body directly adhered to the plate forming the cooking chamber.

Still furthermore, the shape of the high frequency absorbent body is not specifically limited to the aforesaid embodiments, and the shape can be variable according to particular characteristics of the microwave oven which is utilized.

Specifically, one end of the high frequency detecting means can be fixed to a side wall of the cooking chamber while the other end thereof can be freely situated in the space of the cooking chamber.

What is claimed is:

1. A high frequency detecting apparatus comprising:

a high frequency absorbent body formed of compressed high molecular powder for absorbing high frequency from a high frequency generator and generating heat in proportion to the absorbed high frequency;

a temperature detector disposed inside a portion of said body for detecting a temperature of the heat generated by said body; and a thermal insulation material encompassing said portion of said body in which said detector is disposed, with another portion of said body disposed outside said thermal insulation material.

2. The high frequency detecting apparatus according to claim 1, wherein said body comprises $MFe_2O_4$ mixed with a high molecular compound, where M is Mn, Ni, Cu, Zn, Mg, or Co.

3. The high frequency detecting apparatus according to claim 2, wherein said high molecular compound comprises natural rubber.

4. The high frequency detecting apparatus according to claim 2, wherein said high molecular compound comprises synthetic rubber.

5. The high frequency detecting apparatus according to claim 2, wherein said high molecular compound comprises plastic.

6. The high frequency detecting apparatus according to claim 1, wherein said body is formed of compressed particles having a diameter in the range of 1–5 μm.

7. The high frequency detecting apparatus according to claim 6, wherein the particles comprise a ferrite powder.

8. The high frequency detecting apparatus according to claim 1, wherein the temperature detector is fixedly adhered to said body by an adhesive.

9. The high frequency detecting apparatus according to claim 8, wherein the adhesive is silicon resin.

10. The high frequency detecting apparatus according to claim 1, wherein a portion of said body protrudes from said insulation material.

11. The high frequency detecting apparatus according to claim 1, wherein said insulation material includes a groove disposed in the outer periphery thereof for mounting said material to a stationary member.

12. A method of controlling a microwave oven comprising the steps of:

A) initiating operation of a high frequency generator and conducting the high frequency to a cooking chamber for a predetermined time period;

B) causing a high frequency detector disposed in said cooking chamber to generate an output signal in response to detecting said high frequency in said chamber;

C) comparing a value of said output signal with a reference value expected in the event that said high frequency generator is operated for said predetermined time period in the absence of food in said cooking chamber, a magnitude of said reference value determined as a function of a location of said detector in said cooking chamber;

D) continuing to operate said high frequency generator when said value of said output signal is less than said reference value; and E) terminating operation of said high frequency generator when said value of said output signal is greater than said reference value, and generating an audible alarm and displaying a visual indication to alert a user that operation has been terminated.

13. The method according to claim 12, wherein step B includes causing said high frequency detector to absorb said high frequency and produce heat in proportion to the absorbed high frequency, and generate said output signal as a function of measured temperature, and step C comprises comparing a value of said output signal with a reference value representing a temperature expected to occur in said cooking chamber in the event that said high frequency generator is operated in the absence of food in said cooking chamber for said predetermined time period.

14. The method according to claim 12, wherein step C comprises comparing a value of said output signal with a reference value representing an expected value in the event that said high frequency generator is operated in the absence of food in said cooking chamber for said predetermined time period.

15. A microwave oven comprising:

a cooking chamber for receiving food to be cooked;

a high frequency generator for generating a high frequency;

means for conducting the high frequency to said cooking chamber;

a high frequency detector for generating an output signal in response to detecting said high frequency in said cooking chamber;

a controller for comparing a value of the output signal with a reference value representing an expected value in the event that said high frequency generator is operated in the absence of food in said chamber, so that it is determined whether there is food in said chamber, said controller defining means for terminating operation of said high frequency generator in response to a determination of the absence of food in said chamber;

an alarm connected to said controller to be actuated in response to a determination of the absence of food in the chamber;

a body formed of compressed high molecular powder for absorbing high frequency and generating heat in proportion to the absorbed frequency, said detector comprising a temperature detector disposed in a portion of said body; and a thermal insulation material encompassing said portion of said body in which said detector is disposed, with another portion of said body being disposed outside said thermal insulation material and inside said cooking chamber.

16. The microwave oven according to claim 15, wherein said high frequency detector is situated in said chamber, and the magnitude of said reference value is dependent upon the location of said high frequency detector in said chamber.

17. The microwave oven according to claim 15, wherein said alarm comprises a visual display and an audible noise generator.

18. The microwave oven according to claim 15 further including a floor defining a bottom of said cooking chamber, said thermal insulation material including a groove formed in an outer periphery thereof for receiving a hole-defining portion of said floor.

19. A microwave oven comprising:

a cooking chamber for receiving food to be cooked;

a high frequency generator for generating a high frequency;

means for conducting the high frequency to said cooking chamber;

a high frequency detector for generating an output signal in response to detecting said high frequency in said cooking chamber;

a controller for comparing a value of the output signal with a reference value representing an expected value in the event that said high frequency generator is operated in the absence of food in said chamber, so that it is determined whether there is food in said chamber, said controller defining means for terminating operation of said high frequency generator in response to a determination of the absence of food in said chamber;

an alarm connected to said controller to be actuated in response to a determination of the absence of food in the chamber;

a floor defining a bottom of said cooking chamber; and a body formed of compressed high molecular powder for absorbing high frequency and generating heat in proportion to the absorbed frequency, said detector comprising a temperature detector disposed inside a portion of said body, said body mounted in a hole formed in said floor and including a groove formed in an outer periphery thereof for receiving a hole-defining portion of said floor.

* * * * *